United States Patent [19]

Conley

[11] 4,075,944

[45] Feb. 28, 1978

[54] SELF-INDEXING LABEL MARKING GUN

[75] Inventor: Dwain D. Conley, Reno, Nev.

[73] Assignee: Primark Corporation, Palo Alto, Calif.

[21] Appl. No.: 682,024

[22] Filed: Apr. 30, 1976

[51] Int. Cl.[2] ..... B41J 1/20; B41F 1/08

[52] U.S. Cl. ..... 101/94; 101/288; 101/291

[58] Field of Search ..... 101/110, 111, 288–295, 101/94; 156/384–388

[56] References Cited

U.S. PATENT DOCUMENTS

| | | | |
|---|---|---|---|
| 1,143,445 | 6/1915 | Scotford | 101/111 |
| 3,231,446 | 1/1966 | Satas | 101/288 |
| 3,343,485 | 9/1967 | Loeffler | 101/288 |
| 3,440,123 | 4/1969 | Hamisch, Sr. | 101/288 X |
| 3,482,512 | 12/1969 | Jung | 101/110 |
| 3,611,929 | 10/1971 | Schrotz | 101/292 |
| 3,705,833 | 12/1972 | Wada | 101/292 X |
| 3,742,851 | 1/1972 | Hamisch, Sr. | 101/111 X |
| 3,782,279 | 1/1974 | Carboni, Jr. et al. | 101/288 |
| 3,902,952 | 9/1975 | Penaluna | 101/295 X |
| 3,911,817 | 10/1975 | Becker et al. | 101/288 |
| 3,926,110 | 12/1975 | Hubbard et al. | 101/288 X |
| 3,957,562 | 5/1976 | Hamisch, Jr. | 101/288 X |
| 3,968,745 | 7/1976 | Hamisch, Jr. | 101/111 |

*Primary Examiner*—Jay N. Eskovitz

*Assistant Examiner*—Paul J. Hirsch

*Attorney, Agent, or Firm*—Limbach, Limbach & Sutton

[57] ABSTRACT

An improved marking gun for printing and applying adhesive price labels and the like, carried by a tape backing, the gun being of the type having a printing head connected to an operating trigger for imprinting the labels and wherein the improvements include a drive drum having radially projecting teeth for engagement with perforations in the label backing tape together with a pressure roller geared to rotate with the drive drum and exert a sufficient pressure on the backing tape to hold it against the drive wheel such that when the drive drum and pressure roller are initially rotated by the action of squeezing the marking gun trigger, the pulling force thereby exerted on the backing tape is less than the frictional force exerted by the printer which must necessarily be overcome to pull the backing tape and the labels through the printer. In this way, self-indexing is thereby accomplished because the initial rotation of the drive drum and the pressure roller cause the backing tape to slip until the projecting teeth of the drive drum mate with the spaced apart perforations in the backing tape. In the preferred embodiment, the printing head is also spring-coupled to the trigger to provide a constant printing force against the labels to be impressed.

3 Claims, 14 Drawing Figures

SELF-INDEXING LABEL MARKING GUN

BACKGROUND OF THE INVENTION

The invention pertains to a marking gun for printing and applying adhesive labels with pricing and the like and more particularly to a hand-held merchandise marking gun.

Mass marketing of retail goods requires the repetitious marking of individual items with price or other information. Marks may either be directly stamped on the goods or first imprinted on adhesive label and the label affixed to the goods. In order to conveniently apply and print such labels, merchandise marking guns have been developed which carry a supply of adhesive labels on a backing tape and a printing head with a variety of selectable characters which may be impressed on the labels. Typically, in such marking guns, as for example described in U.S. Pat. No. 3,800,701, the labels are separated from the backing tape by passing the backing tape around a sharp radius of curvature. The labels have been printed by a printing head within the gun prior to separation from the backing tape.

A primary problem in constructing a label marker of this type is in accurately advancing the labels to the printing position. Some devices employ friction drive rollers to advance the labels. However, when the rollers pull on the silicon coated backing tape of the adhesive labels, silicon eventually coats the rubber rollers and the rollers cease to operate properly. In other marking devices, shuttle mechanisms are used to advance the labels but the complexity of these mechanisms often leads to high cost, inefficiency, and unreliability.

In the marking gun of the type described in U.S. Pat. No. 3,900,701, a drive wheel having projecting teeth is used to advance the label tape by engaging the teeth in perforations in the tape backing so that positive indexing is thereby achieved. A disadvantage of the mechanism is that the tape must be placed in registration with the teeth of the drive wheel when the tape supply is loaded into the marking gun. Any misregistration can cause jamming of the tape that is in the gun or misregistration in the printing on the labels.

Another problem in label marking guns is in controlling the printing force so that a relatively consistent printing pressure is applied to each label. Since the printing heads are directly coupled to the trigger in many prior art guns, the operator must rely on his subjective judgment as to whether or not he is exerting a constant printing pressure from one label to the next.

Still another problem of merchandise marking guns is that a certain amount of force is required to press the printed label against the merchandise to be marked. This can be done with a roller, however, the roller surface can cause the freshly printed label to be smeared. A further problem is that the application roller must absorb the impact without breaking as the label is pressed onto the goods. Also, in some prior art merchandise marking guns, the ink roller for inking the printing head is difficult to either re-ink or to replace.

SUMMARY OF THE INVENTION

The above and other disadvantages of prior art merchandise marking guns are overcome by the present invention of an improved hand-held adhesive label printer of the type which operates in combination with pre-cut adhesive labels carried on a separable backing tape with regularly spaced apart perforations, the printer having trigger operated means for transporting the tape and labels through the printer and for sequentially separating the labels from the backing tape. The printer further is of the type which includes a printing head with a plurality of selectable characters for imprinting the labels.

In the printer of the invention, the improvements comprise a self-indexing label tape transport and, in one preferred embodiment, a constant printing force printing head. The first feature is accomplished by means of a drive drum which is rotatably mounted in the printer to contact the backing tape and which has a plurality of circumferentially spaced apart, radial projections for mating with the spaced perforations in the backing tape. The drive drum is selectively rotatable by the trigger operated means. Resiliently loaded pressure roller means, interengaged to rotate with the drive drum, pull the label backing tape against the drive drum and initially exert a pulling force on the label backing tape which is less than the frictional force exerted by the printer on the backing tape and labels, which must be overcome to pull the backing tape and labels through the printer. In this manner, self-indexing of the label tape in the printer is accomplished because the initial rotation of the drive drum and pressure roller means cause the backing tape to slip relative to the rotating drive drum until the projections of the drive drum mate with the spaced apart perforations in the backing tape to thereby exert a positive pulling force which overcomes the printer's frictional force on the backing tape.

In one preferred embodiment, the constant printing pressure feature is achieved by means of a pair of spaced apart support arms for the printing head, the arms being pivoted at corresponding ends to the marking gun case. The hand-operable trigger is pivotally mounted to the marking gun case. A torsion spring interconnects the trigger and the printing head supports for causing the printing head supports to pivot the printing head against a label with a predetermined pressure each time the trigger is manually rotated about its pivot.

In order to absorb the impact of the label application when a label is applied to the goods to be marked, an improved application roller is rotatably mounted in the printer for pressing the separated labels against the surface of the goods to be marked. The application roller of the present invention is cylindrical and has a plurality of resilient fingers projecting from its outer surface. These resilient fingers not only absorb the impact of the label application, but also greatly reduce the contact with the face of the freshly printed label and thereby reduce smearing of the printed image.

The label printer in the embodiments of the present invention includes a disposable ink roller which can be conveniently pulled out of the printer and removed. This is accomplished in a preferred embodiment of the present invention by means of a first ink roller support pivotally mounted at one end to the printer and movable between an open position, extending out of the printer, and a closed position, flush with or inside the printer. A second ink roller support is pivotally mounted at one end to the first ink roller support and has a permanently inked roller removably mounted at its opposite end. A torsion spring is attached between the first and second ink roller supports for biasing the end of the second ink roller support on which the ink roller is mounted in a direction toward the printing head when the first ink roller support is in its closed position. The torsion spring also biases the second ink roller support out of the printer when the first ink roller support is in the open position.

In the preferred embodiments of the present invention, the supply of label tape is supported on a rotatable spindle mounted in the printer. This allows for the use of both core and coreless tape label rolls.

It is, therefore, an object of the present invention to provide a label marker which is self-indexing.

It is another object of the present invention to provide a label marker having a constant printing force on the labels.

It is still another object of the present invention to provide a label marker which absorbs the impact in applying the label to the object to be marked without smearing the print on the label.

It is still another object of the invention to provide a label marker having a quick release, disposable printing head ink roller.

The foregoing and other objectives, features and advantages of the invention will be more readily understood upon consideration of the following detailed description of certain preferred embodiments of the invention, taken in conjunction with the accompanying drawings.

DETAILED DESCRIPTION OF THE PREFERRED EMBODIMENTS

Figure 1:
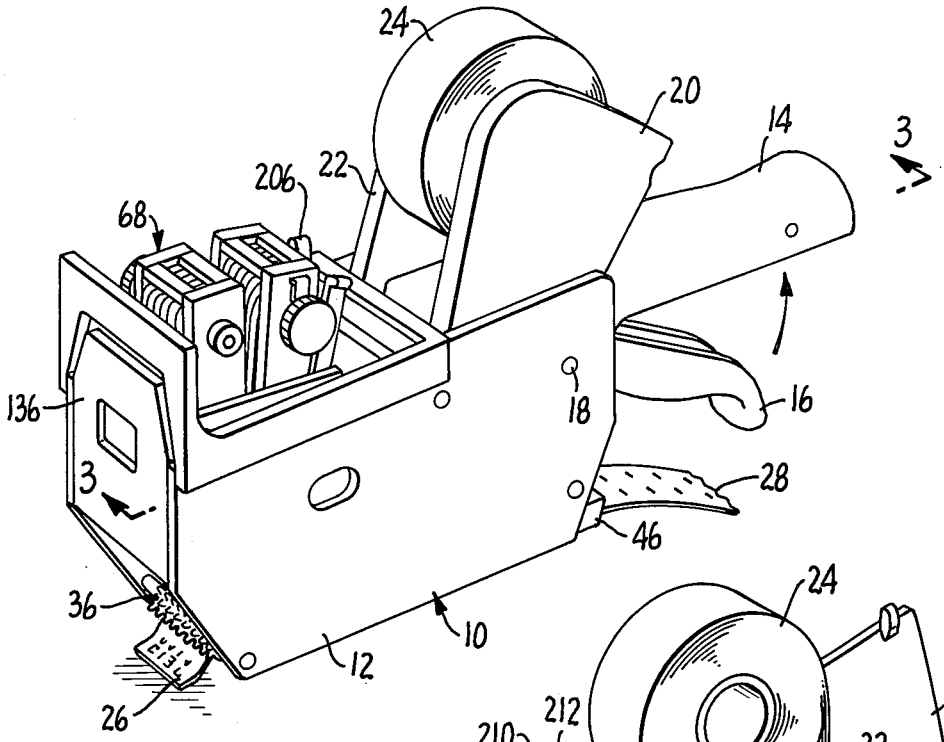
FIG. 1 is a perspective view of the adhesive label printer according to the invention.
Figure 2:
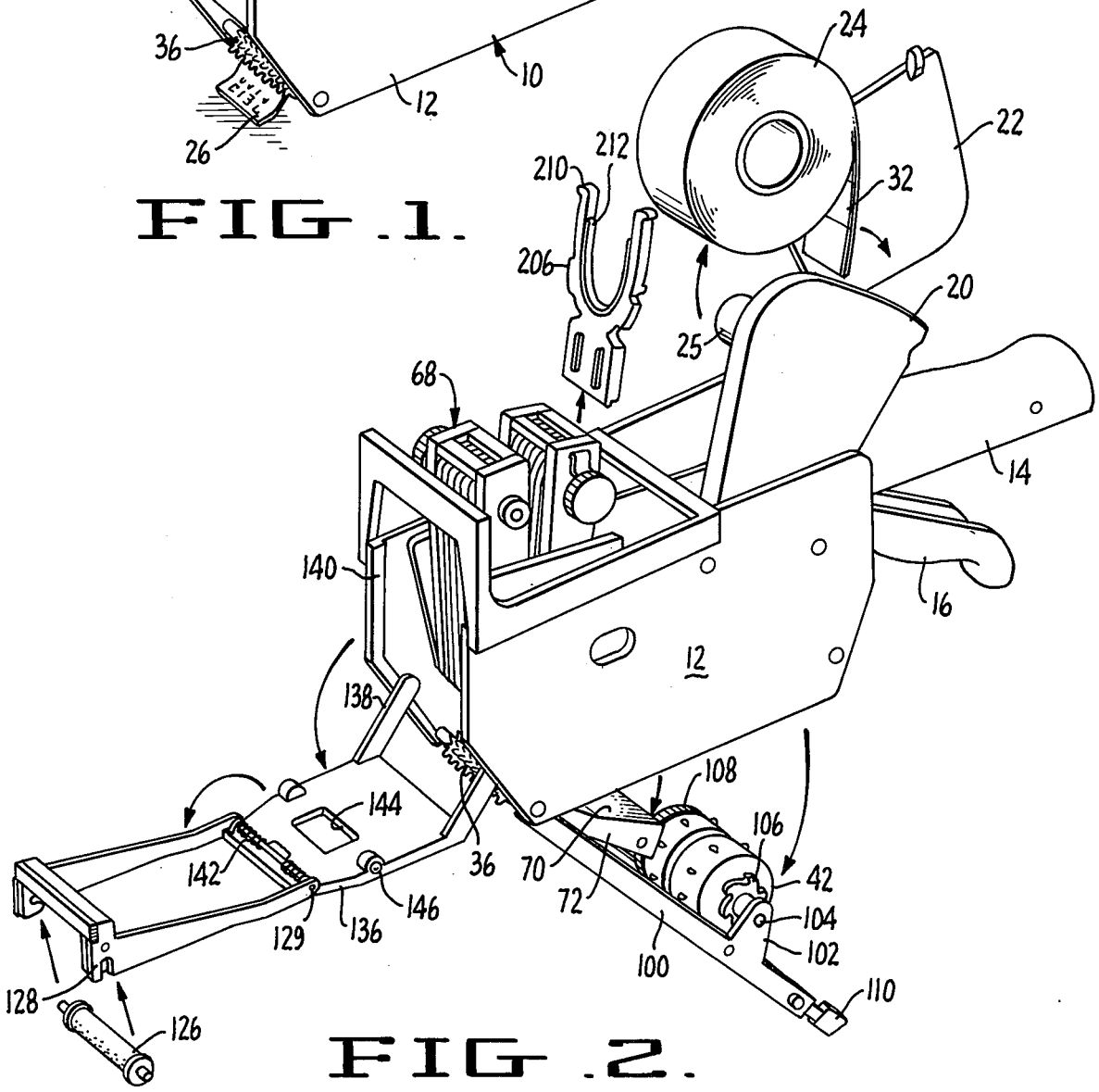
FIG. 2 is a perspective, partially exploded view of the adhesive label printer depicted in FIG. 1 with certain components in the open position.

Referring now more particularly to FIGS. 1 and 2, the marking gun 10 is illustrated as having a generally rectangular casing 12 with a protruding, rigid handle 14. Beneath the handle 14, as viewed in FIGS. 1 and 2, is a hand grip operated trigger 16 pivotally mounted in the casing on a shaft 18. Also projecting from the housing 12 are a pair of flanges 20 and 22 between which is supported a spool 24 of label tape 32.

The flange 22 is pivoted to the housing 12 to allow the insertion and removal of the tape spool 24 (see FIG. 2). The spool 24 is carried on a sleeve 25 which is rotatably mounted on the flange 20. The tape 32 (see FIG. 10) is of the type which has a plurality of adhesive labels 26 and a continuous backing tape 28 which carries the labels 26. The backing tape 28 has pairs of incremental transverse and centrally located perforation slits 30 positioned adjacent the incremental label cuts of the pre-cut adhesive labels 26.

Figure 3:
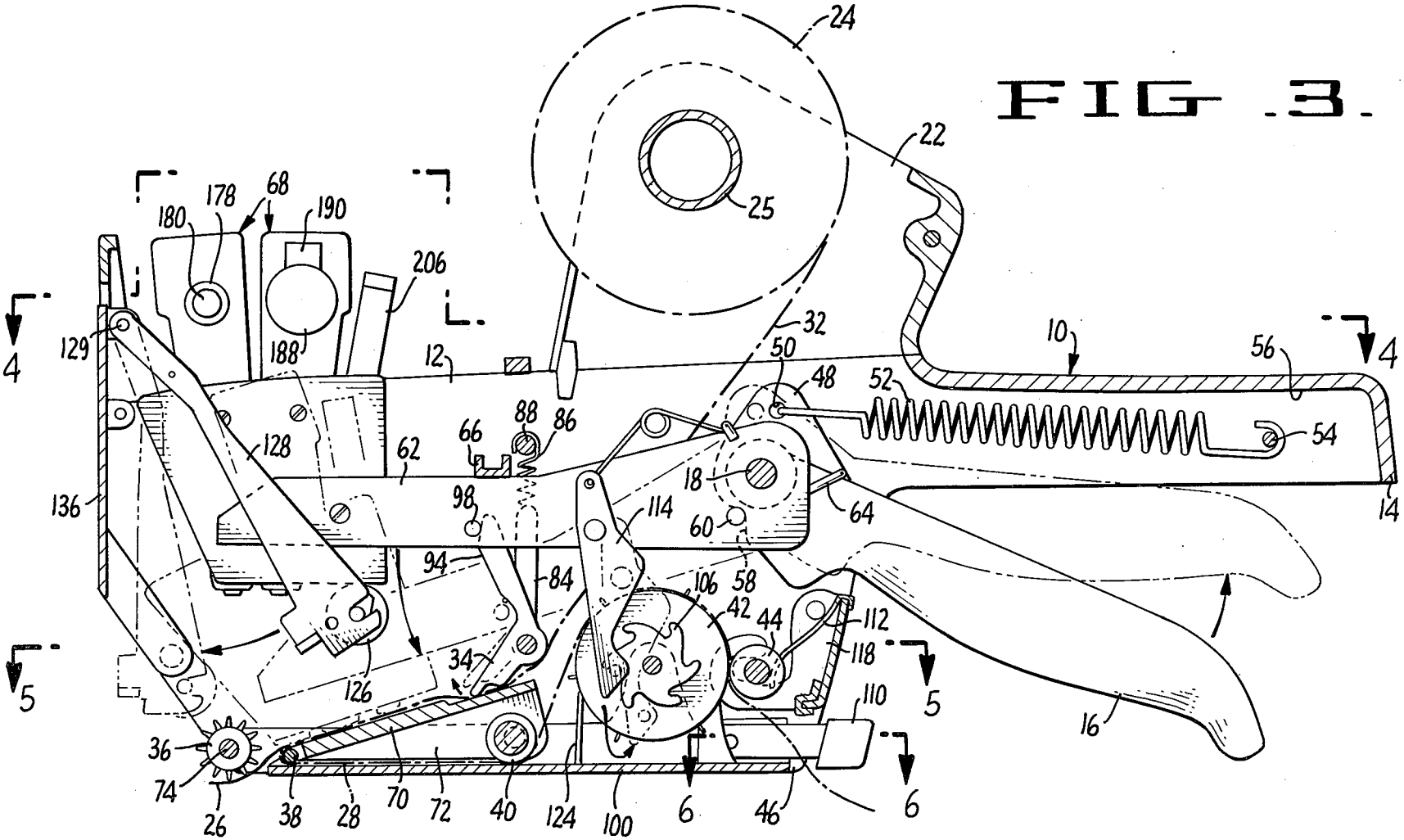
FIG. 3 is an enlarged, vertical, sectional view, taken generally along the lines 3—3 of FIG. 1.

Referring now to FIG. 3, in threading the tape 32 into the marking gun 10, the adhesive label tape 32 unwinds from the roll 24 and passes through the housing 12 beneath a dual pressure foot 34, and between an application roller 36 and a rearwardly spaced, parallel shaft 38.

Figure 10:
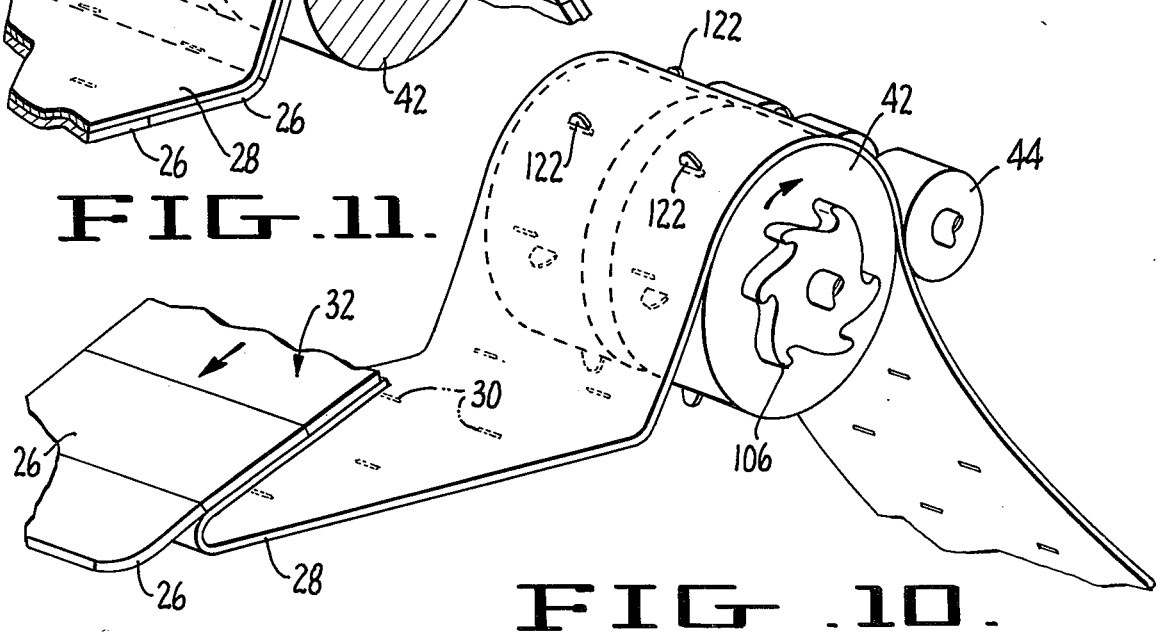
FIG. 10 is an enlarged, perspective view, of the drive drum and pressure roller backing tape transport mechanism of the adhesive label printer of the invention.
Figure 12:
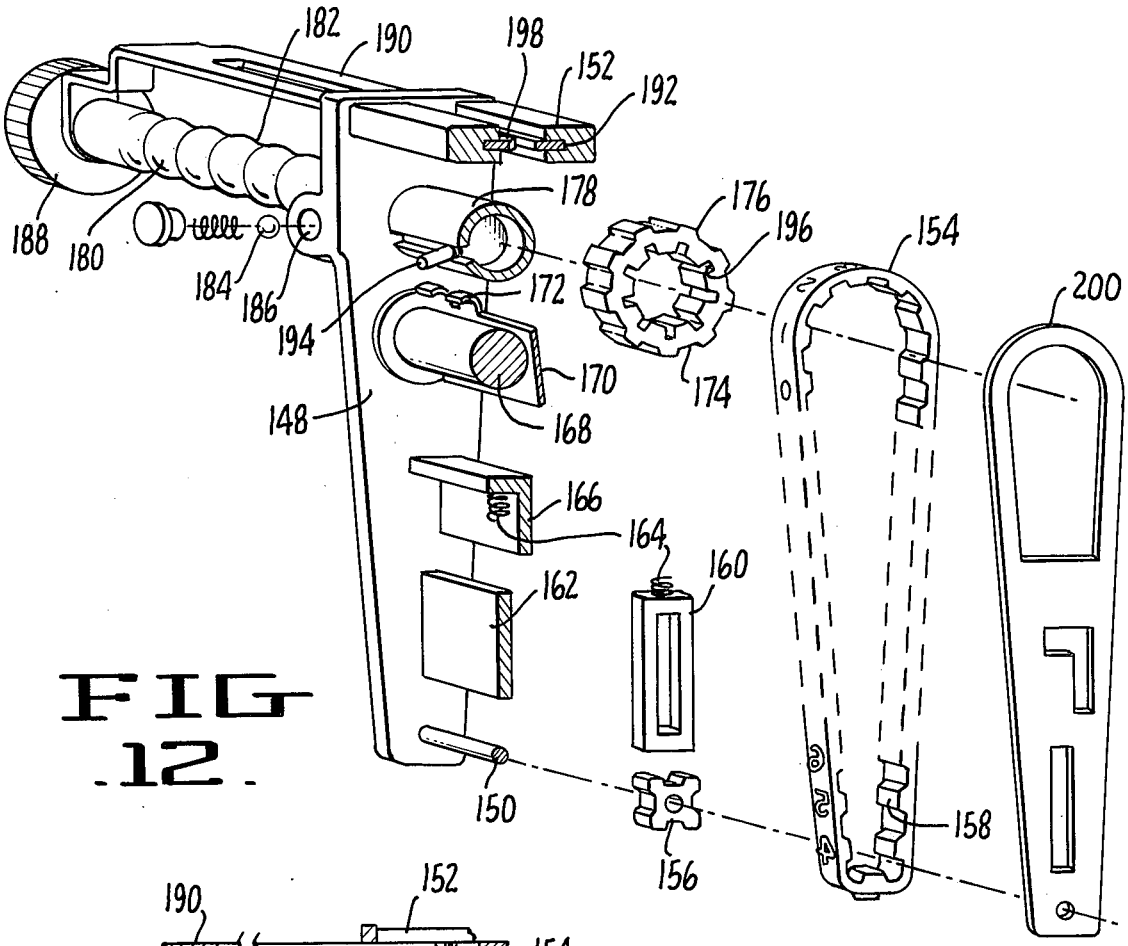
FIG. 12 is an enlarged, perspective, exploded view, partially in section, of a portion of one of the printing heads of the adhesive label printer of the invention.
Figure 13:
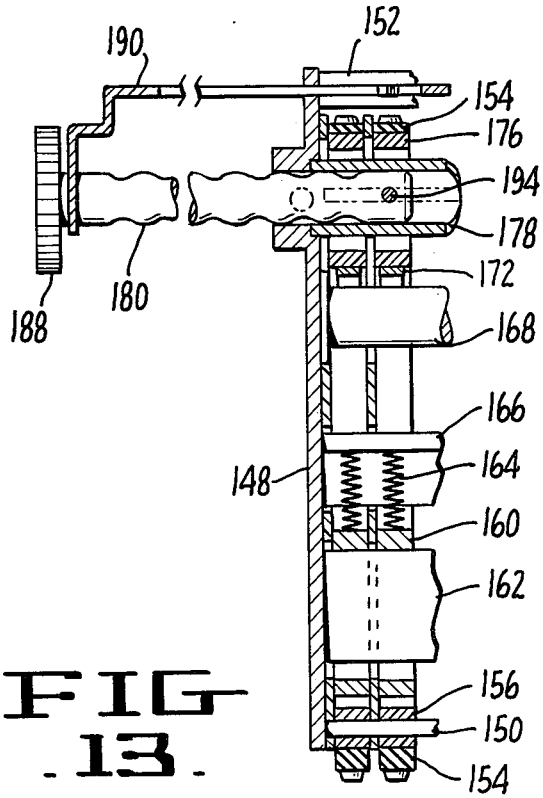
FIG. 13 is a vertical, sectional view, taken generally along the lines 13—13 of one of the printing heads of the invention during the printing character setting function.
Figure 14:
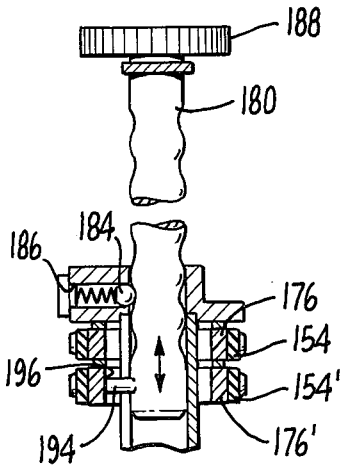
FIG. 14 is a horizontal, sectional view, taken generally along the lines 14—14 in FIG. 7, of one of the printing heads of the invention during the character setting phase.

As is illustrated in FIG. 10, the labels 26 separate from the backing tape 28 in passing around the shaft 38. The separated labels are applied to the goods to be marked, as will be described in greater detail hereinafter. The backing tape 28 further extends beneath a roller 40, up and over a drive drum 42, and between the drive drum 42 and a rearwardly spaced pressure roller 44 to exit from the case 12 from an exit point 46. The rollers 36, 40 and 44 as well as the shaft 38 and the drive drum 42 are all parallel to each other and are contained within the casing 12 when the marking gun 10 is operated. As will be described further, however, they can be swung out of the casing 12 to load the marking gun 10.

Figure 7:
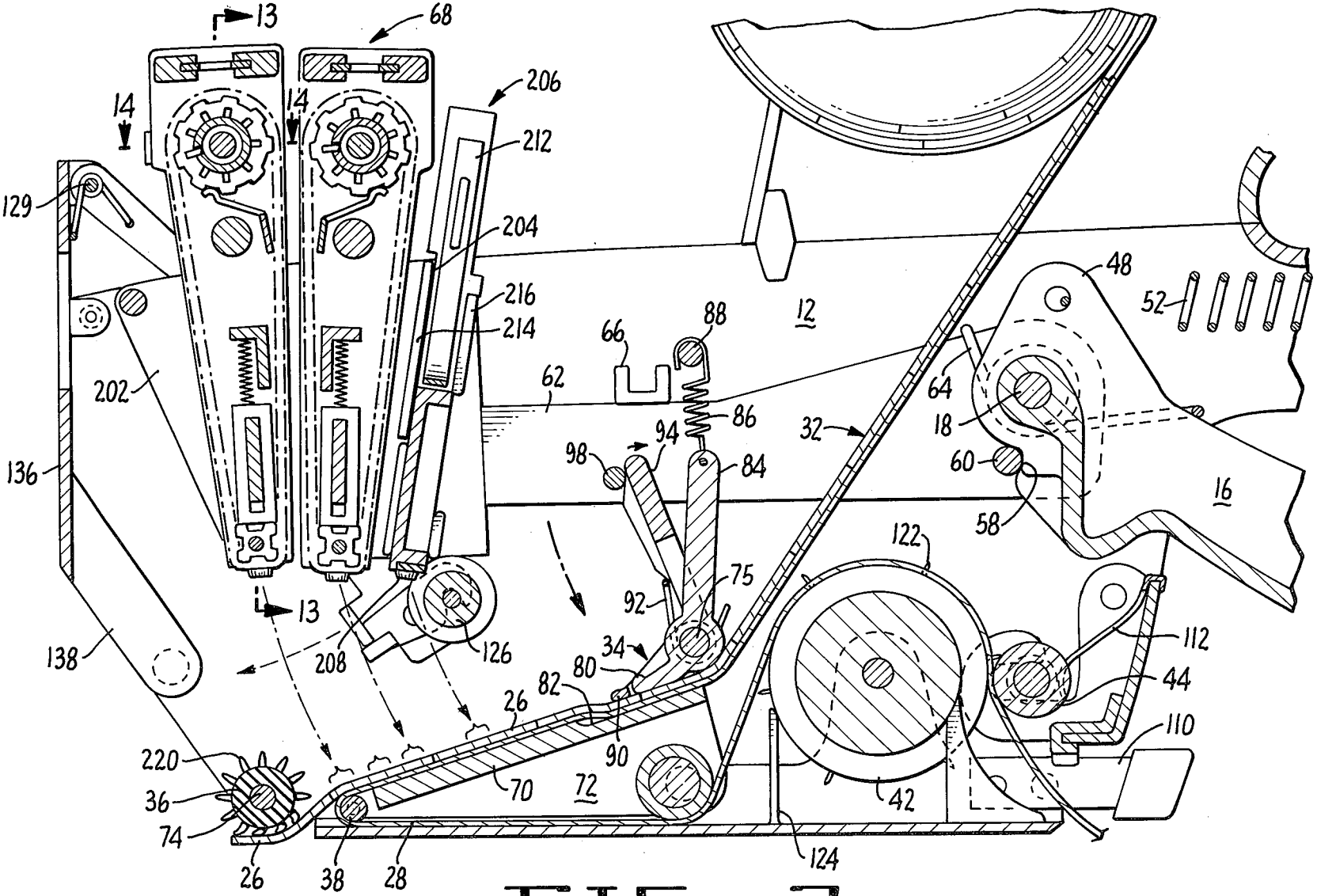
FIG. 7 is an enlarged, vertical, sectional view taken generally along the lines 7—7 of FIG. 4.

Referring now more particularly to FIGS. 3, 7 and 10, the self-indexing tape transport means of the marking gun of the invention will be described in greater detail. All directional references, such as above, below, forwardly (i.e., to the left) and rearwardly (i.e., to the right) are with respect to the gun as depicted in these Figures. The handle trigger 16 includes a upwardly extending boss 48. This boss 48 includes a hole 50 through which one end of a tension spring 52 is engaged. The other end of the spring 52 is hooked around a transverse bar 54 spanning the interior hollow space 56 of the handle 14. By this means, the spring 52 causes the trigger 16 to normally be rotated in a clockwise direction until a notch 58 at the base of the trigger 16 engages a pin 60 which spans the space between a pair of printing head support arms 62.

Figure 4:
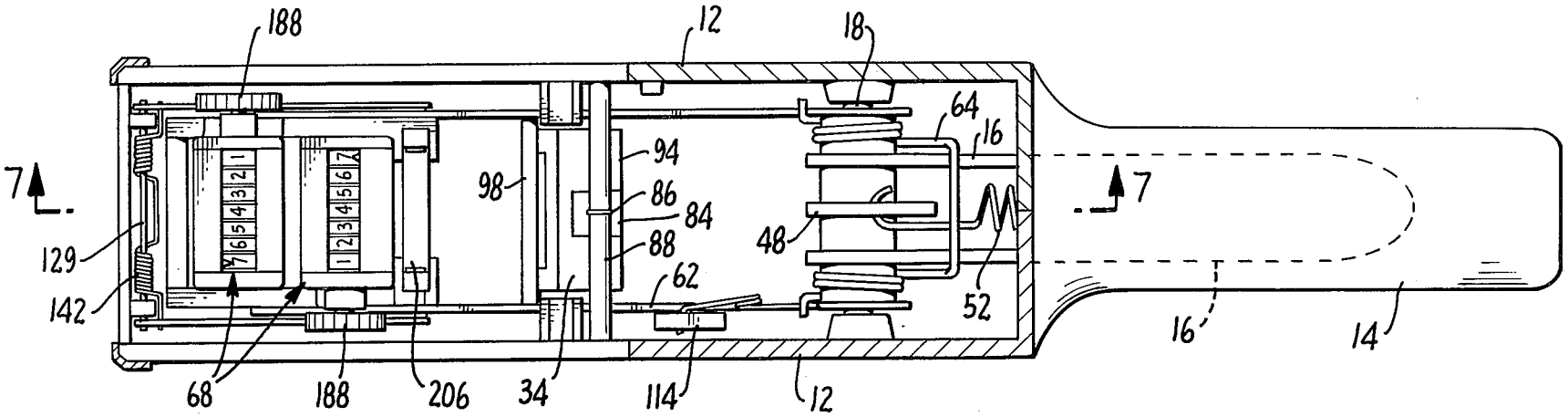
FIG. 4 is a horizontal, sectional view taken generally along the lines 4—4 of FIG. 3.

As perhaps best seen in FIG. 4, the support arms 62 pivot about the same shaft 18 as does the trigger 16. A torsion spring 64 bears at one end against the trigger 16 and at its other end against the arms 62. In this manner, a counterclockwise motion of the trigger 16 transmits a rotational force in the same direction to the printing head support arms 62. This counterclockwise force, however, is transmitted solely through the spring 64. When the operator releases the trigger 16, the spring 52 causes the trigger to rotate in a clockwise direction until the notch 58 bears against the pin 60 thereby moving the printing support arms 62 in the clockwise direction. A stop 66 mounted within the casing 12 above the support arms 62 limits the extent of their clockwise travel.

A pair of printing heads designated generally by the reference numeral 68 are mounted on the forward ends of the support arms 62 and thus, they pivot with the support arms 62 about the shaft 18. When the printing heads 68 have pivoted counterclockwise to their fullest extent, they bear against the labels 26 which are positioned over an inclined, flat plate 70 of a member 72 which is pivoted about a shaft 74 which supports the application roller 36. As best viewed in FIG. 2, the member 72 carries the label separator shaft 38 and can be pivoted out of the case 12 to facilitate threading of the tape 32.

Figure 8:
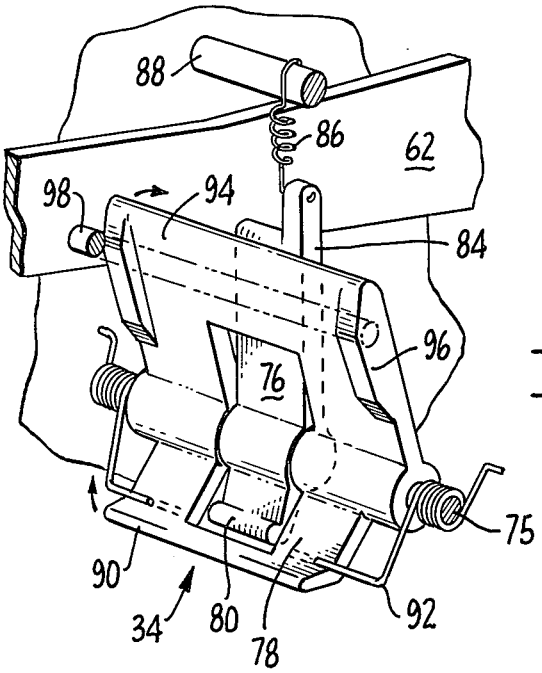
FIG. 8 is an enlarged, perspective view, of a pressure foot for use in the adhesive label printer as depicted in FIG. 1.

In order to control the tension on the tape 32, both during the imprinting operation and during the tape advancement operation, the pressure foot 34 is divided into two parts. Both parts pivot about a horizontal shaft 75 mounted within the casing 12. As perhaps can best be viewed in FIG. 8, a central portion 76 of the foot 34 pivots independently of two joined together outer portions 78 on either side of the central portion 76. The central portion 76 has a rounded lower edge 80 which presses the label tape 32 against a smooth, recess 82 at the upper end of the support surface 70. The central portion 76 includes a lever arm 84 on the opposite side of the shaft 74 from the lower rounded portion 80. The arm 84 is attached at one end by a tension spring 86 to a horizontal pin 88 mounted within the casing 12. By means of the spring 86 acting through the lever arm 84, the rounded portion 80 bears against the tape 32 with a relatively constant force.

The outer portion 78 also includes a lower, rounded foot portion 90 which is pressed against the tape 32 alongside of the portion 80 under the force of a torsion spring 92, one end of which bears against the foot portion 90. The other end of the torsion spring 92 is fastened to the case 12. The lever arm portion 94 of the pressure foot 78 includes a pair of ridges 96 on its forward end. These cam ridges 96 bear against a shaft 98 fastened between the printing head support arms 62. The position of the shaft 98 with respect to the cam ridges 96 is such that when the trigger 16 is squeezed to rotate the printing head support arm 62 in the counterclockwise direction, the shaft 98 will ride down over the cam ridges 96 and cause the pressure foot 78 to rotate in the clockwise direction. The shaft 98 continues to ride downwardly on the cam ridges 96 until it passes over them at their bottom edges and the upper portion 94 of the pressure foot 78 again rotates in the counterclockwise direction due to the spring 92. At this point, the label is imprinted by the pressing heads 68.

Upon the return of the support arms 62 to their extreme clockwise position, the process is repeated in reverse and the shaft 98 again rides over the cam ridges 96 to relieve the tension put upon the tape 32 by the pressure foot 78. Simultaneously, with the release of the pressure foot 78, the tape 32 is being pulled through the marking gun by the action of the drive drum 42 as will be explained in greater detail hereinafter. Also, at this point, a label 26 is being separated from the backing tape 28 as the tape 32 passes around the shaft 38. The reason that the label 26 separates from the backing tape 38 is, as is well known to those skilled in the art, due to the relative inflexibility of the label 26 as compared with the very flexible backing tape 28 which easily negotiates the radius of the shaft 38. During this separation operation, it is desirable for smooth feeding to minimize the tension on the tape 32 and therefore the clockwise rotation of the pressure foot 90 facilitates this label separation process while the central pressure foot 80 maintains a minimum tension on the tape 32.

Figure 6:
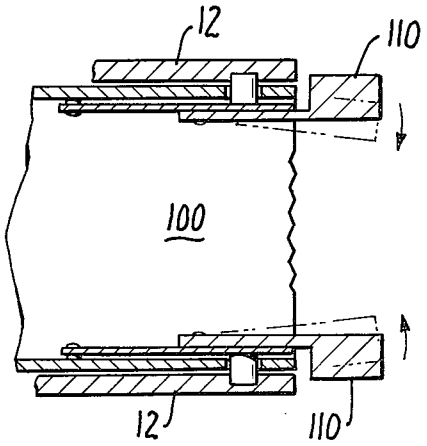
FIG. 6 is a horizontal, sectional view, with portions broken away and taken generally along the lines 6—6 of FIG. 3.

Referring now more particularly to FIGS. 2, 3, 10 and 11, the mechanism for transporting the tape 32 through the marking gun will be described in greater detail. In addition to the printing support member 72 which is pivoted about the shaft 74 within the case 12, a second frame member 100 is also pivoted about the same shaft. The frame 100 has two upstanding flange members 102 between which is mounted a shaft 104. The drive drum 42 is rotatably mounted about the shaft 104. A ratchet wheel 106 is mounted at the near end of the drive drum 42 in the figures and a gear 108 is mounted at the other end of the drive drum 42. Both the ratchet gear 106 and the toothed gear 108 are attached to the drive drum 42 as an integral unit which rotates about the shaft 104. As best viewed in FIG. 6, a pair of spring loaded locking tabs 110 at the right most end of the frame 100 lock the frame flush with the bottom of the casing 12. Because the frame 100 is pivoted to open out of the case 12, the tape may be easily threaded around the drive drum.

Referring particularly to FIG. 3, when the frame 100 is in the closed position, the tape 32 is drawn upwardly around the roller 40, over the drive drum 42 and between the drive drum 42 and the pressure roller 44. The pressure roller 44 is forced by means of a spring 112 against the outer surface of the drive drum 42. The ratchet wheel 106 engages a spring loaded pawl 114 rotatably mounted on the printing support arms 62. Thus, the counterclockwise and then clockwise movement of the support arms 62 lowers the pawl 114 to engage the ratchet wheel 106 and rotate it in the clockwise direction during a complete cycle of gripping and releasing the trigger 16.

Figure 5:
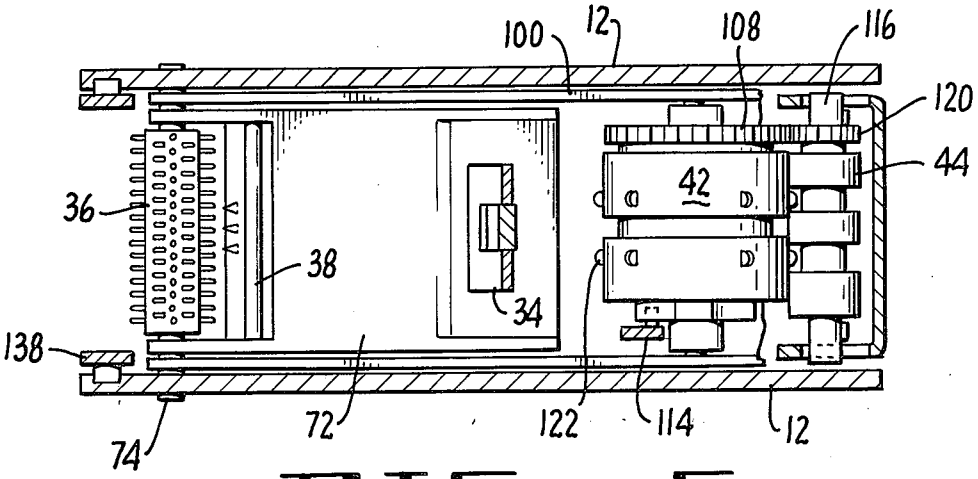
FIG. 5 is a horizontal, sectional view taken generally along the lines 5—5 of FIG. 3.

As best shown in FIG. 5, the pressure roller 44 is rotatably mounted on a shaft 116 carried by a hook-shaped support 118 attached to the case 12. The pressure roller 44 includes an integral gear 120 also mounted on the shaft 116. The gear 120 meshes with the gear 108 of the drive drum 42 and they rotate synchronously. The force of the spring 112 is chosen such that the pulling force exerted by the drive drum 42 and the pressure roller 44 on the tape 32 initially is insufficient to overcome the frictional force of the marking gun 10 on the tape 32. This causes the tape 32 to slip somewhat relative to the rotating drive drum 42.

The drive drum 42, however, includes a plurality of circumferentially spaced, radially projecting teeth 122. These teeth 122 are aligned in pairs about the circumference of the drive drum 42 and are spaced apart by approximately the circumferential distance corresponding to the length of a single label 26 which is also the spacing of the perforations 30.

The tape thus initially slips as the drive drum is rotated until a pair of the teeth 122 engage in the perforations 30 at which point positive pulling force is thereby obtained. This amounts to a self-indexing of the tape transport so that the tape labels 26 will be accurately aligned with respect to the printing heads 68. In order to prevent the drive drum 42 from being rotated in a counterclockwise direction, a flexible prong 124 extends upwardly from the support 100 to bear against the outside surface of the drive drum 42 so as to engage with the projections 122. The flexible member 124 acts in the manner of a stop ratchet.

Figure 9:
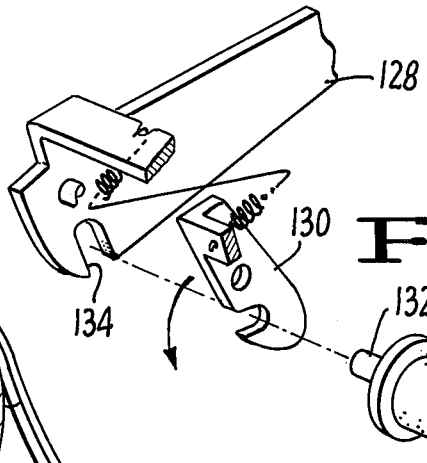
FIG. 9 is an enlarged, perspective view of the ink roller removal mechanism of the adhesive label printer of the invention.
Figure 11:
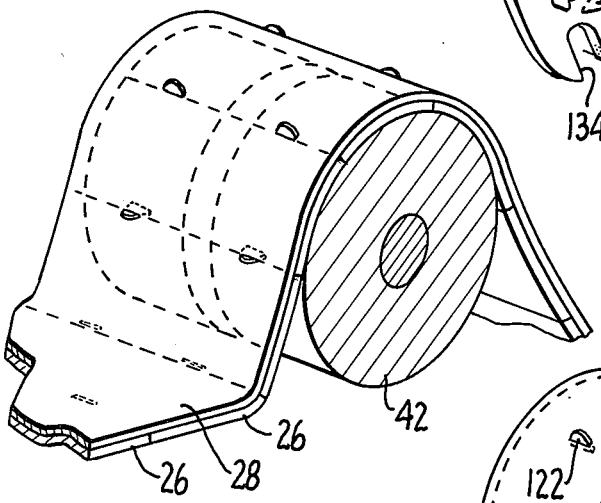
FIG. 11 is an enlarged, perspective view, partially in section, of the drive drum of the adhesive label printer of the invention during the self-indexing phase.

Referring now more particularly to FIGS. 1, 2 and 3, the ink roller support mechanism for the marking gun 10 will be described. In order to keep the printing heads 68 inked, a disposable, pre-inked roller 126 is detachably mounted at one end of a frame 128. As best shown in FIG. 9, the detachable mounting includes a spring loaded hook 130 which grasps the shaft 132 of the ink roller 126 and holds it in a recess 134 of the frame 128. Counterclockwise movement of the hook 130 will release the shaft 132 out of the recess 134 allowing the roller 126 to drop free.

The frame 128 is pivotally mounted by means of a pivot shaft 129 at one end of another frame 136. The opposite end of the frame 136 has two inclined legs 138 which are rigidly attached to the frame 136 and which are pivotally mounted at their opposite ends to the case 12 at its extreme leftmost or forward end. This end of the casing 12 includes an opening 140 whose upper half dimensions correspond roughly to the cross-sectional area of the frame 136. A torsion spring 142 is fastened about the pivotal shaft 129 between the support frames 128 and 136 causing the frame 128 to rotate counterclockwise with respect to the frame 136.

The frame 136 may be supported in an open position, as viewed in FIG. 2, or in a closed position, as viewed in FIG. 1, in which it is flush with the exterior surface of the case 12. To put the frame 136 in the closed position, the frame 128 is first rotated clockwise and then the frame 136 is moved to its closed position. This forces the ink roller 126 against the bottom surface of the printing head 68 within the case 12, as best shown in FIG. 3. The frame 136 includes a gripping aperture 144 to move it to its open position and further includes a pair of spring loaded catches 146 which hold the frame 136 in its closed position within the case 12. In this manner, the ink roller 126 can be easily replaced by opening the frame 136 and allowing the frame 128 to pop out to an open position. Thereafter, the hook 130, which is pivotally mounted to the frame 128, is rotated counterclockwise to release the ink roller 126, which drops free. A new ink roller is then inserted and the frame 136 is closed.

Referring now more particularly to FIGS. 1, 7 and 12 – 14, the printing heads 68 will be described in greater detail. Since the printing heads 68 are virtually identical to each other, only one of the heads will be described, it being understood that the other head is substantially a duplicate thereof, but turned 180°. Each printing head includes a pair of spaced apart side pieces 148 which are held in their spaced apart position by a shaft 150 at the lower end thereof and by a pair of slotted spacer members 152 at their upper ends. A plurality of printing bands 154 are rotatably supported between the side pieces 148 and parallel to each other. The rotatable support for the printing bands 154 allows them to be separately rotated to display different printing indicia.

This printing band support means for each band includes a generally rectangular gear shaped member 156 which is rotatably supported about the shaft 150 and which engages rubberized teeth 158 on the interior circumference of the bands 154. A slotted rectangular member 160, which slides on a vertical, flat, rectangular support 162, extending between the side pieces 148, is spring biased against the gear 156 to act as a detent. The rectangular spacer member 160 is spring biased by means of a compression spring 164 which extends between the top of the spacer 160 and the top flange of a strut 166 which extends between the side pieces 148. Above the strut 166, a cylindrical strut 168 also supports the side pieces 148 in a spaced apart position. Additionally, the strut 168 captures and supports a member 170 which has a plurality of resilient fingers 172 each of which bears against a recessed detent 174 in a separate band support wheel 176.

Each band 154 extends over a separate support wheel 176. The wheels 176 are rotatably mounted on a slotted sleeve 178 which extends between the side pieces 148. The sleeve is rotatable in the side pieces 148. Contained within the sleeve 178 is a shaft 180 having a plurality of longitudinal detents 182 corresponding to the different wheels 176 for each band. A spring loaded ball 184 mounted within a passage 186 in one of the side pieces 148, resiliently captures the shaft 180 at each detent 182. The shaft 180 is provided with a knurled knob 188 at its end on the outside of the side piece 148. A sliding, flat, slotted metal support 190 is movably fitted between longitudinal grooves 192 in the top support pieces 152. The outer end of the support 190 is bent downwardly in a flange to rotatably support the end of the shaft 180 at the point where it joins the knob 188. A radially projecting pin 194 is at the end of the shaft 180 which is opposite from the knob 188. This pin 194 is dimensioned to engage in circumferentially spaced, interior slots 196 in each of the band support wheels 176. As the knob 188 is turned, the shaft 180, the pin 194 and the sleeve 178 also turn.

Thus, in order to adjust the printing indicia on the band 154 so that a particular character is at the lower extreme thereof, the shaft 180 is slid longitudinally within the sleeve 178 until the pin 194 is correctly aligned with the proper support wheel 176. At this point, the shaft 180 will be captured by the ball 184 and the knob 188 may be turned to thereby rotate the wheel 176 and thus the band 154 until the proper character is displayed. As a precaution, the case 12 is dimensioned so that when the shaft 180 is extended out of the sleeve 178 the unit is inoperable.

Each band is equipped with two sets of corresponding characters. One set is readable in normal style, whereas a corresponding, aligned set at the bottom of the band, is raised in mirror image style to give the proper printed character. A pointer 198 on the flange 190 is aligned with the pin 194 to show which of the wheels 176 is engaged. Plastic spacers 200 are fitted over the shafts 178, 168 and the supports 166, 162 and 150 in order to separate the different bands 154 from each other.

The separate printing heads 68 are mounted within a frame 202 which is fastened between the printing head support arms 62. At the rearmost portion of the frame, a pair of slots 204 receive a wishbone-shaped slug holder 206. The holder 206 includes a printed slug 208 at the bottom thereof which imprints against the label preceding the labels which are imprinted by the printing heads 68. The wishbone-shaped arms 210 of the slug holder 206 are resiliently spread apart by an interior, U-shaped spring 212. A pair of forward and rear ridges 214 and 216, respectively, are dimensioned to receive the corresponding contour 218 of the slug holder 206 to prevent the slug holder from being placed in the frame 202 backwards.

The operation by which the printing indicia on the printing head 68 and the slug 208 are automatically inked, will now be described in reference to FIG. 7. The ink roller 126 carried at the end of the pivoted support frame 128, is spring biased to reside against the slug 208 when the printing head support arms 62 are in their uppermost position. As the arms 62 are caused to rotate counterclockwise and downwardly by depression of the trigger 16, as indicated by the arrow in the figure, the ink roller 126 pivots about the shaft 129 and is caused to swing in a clockwise direction and to roll over the bottoms of the printing heads 68, thereby inking the characters. The process is reversed when the printing head support arms 62 are raised to their uppermost position after the imprinting of the labels 26. The alignment of the printing heads 68 is such that they imprint the labels 26 above and below the imprint previously made by the slug 208.

As can best be seen in FIGS. 7 and 10, at the point where the label 26 separates from the backing tape 28, it extends out of the front of the marking gun 10. The operator then presses the label 26 against the object to be marked and moves the marking gun 10 backwards to use the roller 36 to press the label 26 onto the goods. The application roller 36 has a plurality of resilient, radially projecting spikes 220 which bear against the label 26 without smearing the imprinted image. These spikes also cushion the impact to the gun 10 as the label is applied to the goods to be marked by bending.

The terms and expressions which have been employed here are used as terms of description and not of limitations, and there is no intention, in the use of such terms and expressions, of excluding equivalents of the features shown and described, or portions thereof, it being recognized that various modifications are possible within the scope of the invention claimed.

What is claimed is:

1. An improved adhesive label printer of the type which operates in combination with pre-cut adhesive labels carried on a separable backing tape with regularly spaced apart perforations, the printer having trigger operated tape transport means for transporting the backing tape and labels through the printer and for sequentially separating the labels from the backing tape, the tape transport means having non-trigger operated portions which exert a retarding frictional force against the movement of the backing tape through the printer, and a printing head with a plurality of selectable characters for imprinting the labels, wherein the improvement comprises a drive drum, the drive drum being rotatably mounted in the printer to contact the backing tape, and having a plurality of circumferentially spaced apart, radial projections for mating with the spaced apart perforations in the backing tape, the drive drum being selectively rotatable by the trigger operated means, spring loaded pressure roller means mechanically interengaged to rotate with the drive drum and to resiliently press the backing tape against the drive drum, the roller means and drive drum together initially exerting a frictional pulling force on the label backing tape which is less than the retarding frictional force exerted by the tape transport means on the backing tape and labels which must be overcome to pull the backing tape and labels through the printer, whereby self-indexing is accomplished when the initial rotation of the drive drum and pressure roller means causes the backing tape to slip over the drive drum projections until the projections of the drive drum mate with the spaced apart perforations in the backing tape upon initial operation of the trigger operated tape transport means.

2. An improved label printer as recited in claim 1 further comprising ink roller means engageable with selected characters on the printing head for inking the selected characters, the ink roller means including a first ink roller support pivotally mounted at one end to the printer and movable between an open position, extending out of the printer, and a closed position, a second ink roller support pivotally mounted at one end to the first ink roller support and having the ink roller removably mounted at its opposite end, and a spring attached between the first and second ink roller supports for biasing the end of the second ink roller support on which the ink roller is mounted in a direction toward the printing head when the first ink roller support is in the closed position and for biasing the second ink roller support out of the printer when the first ink roller support is in the open position.

3. An improved adhesive label printer of the type which operates in combination with pre-cut adhesive labels carried on a separable backing tape with regularly spaced apart perforations, the printer having trigger operated tape transport means for transporting the backing tape and labels through the printer and for sequentially separating the labels from the backing tape, the tape transport means having non-trigger operated portions which exert a retarding frictional force against the movement of the backing tape through the printer, and a printing head with a plurality of selectable characters for imprinting the labels, wherein the improvement comprises drive means, the drive means including a driving member movably mounted in the printer to contact the backing tape, and having a plurality of spaced apart, projections for mating with the spaced apart perforations in the backing tape, the drive member being selectively movable by the trigger operated means, spring loaded pressure means mechanically interengaged to move with the drive member and to resiliently press the backing tape against the drive member, the pressure means and drive member together initially exerting frictional pulling force on the label backing tape which is less than the retarding frictional force exerted by the tape transport means on the backing tape and labels through the printer, whereby self-indexing is accomplished when the initial movement of the drive member and pressure means causes the backing tape to slip over the drive member projections until the projections of the drive member mate with the spaced apart perforations in the backing tape upon initial operation of the trigger operated tape transport means.

* * * * *